US009257080B2

(12) United States Patent
Tachibana

(10) Patent No.: US 9,257,080 B2
(45) Date of Patent: Feb. 9, 2016

(54) DISPLAY PANEL DRIVING CIRCUIT AND DISPLAY DEVICE

(71) Applicant: Hiroshi Tachibana, Tokyo (JP)

(72) Inventor: Hiroshi Tachibana, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 25 days.

(21) Appl. No.: 13/852,916

(22) Filed: Mar. 28, 2013

(65) Prior Publication Data

US 2013/0278489 A1 Oct. 24, 2013

(30) Foreign Application Priority Data

Apr. 23, 2012 (JP) ..... 2012-097444

(51) Int. Cl.
*G09G 3/36* (2006.01)

(52) U.S. Cl.
CPC ..... *G09G 3/3611* (2013.01); *G09G 3/3688* (2013.01); *G09G 2310/0283* (2013.01); *G09G 2370/08* (2013.01)

(58) Field of Classification Search
CPC ..... G06F 2203/04113; G06F 3/044; G06F 3/045; G06F 13/18; G06F 17/24; G06F 3/153; G06F 13/37; G06F 3/1423; G06F 9/4812; G09G 5/10; G09G 2300/0465; G09G 2300/0486; G09G 2300/0814; G09G 2300/0861; G09G 2310/0205; G09G 2310/0254; G09G 2310/0283; G09G 2310/06; G09G 2320/02; G09G 2320/0271; G09G 2320/0613; G09G 2320/0223; G09G 3/2014; G09G 2360/18; G09G 2310/0267; G09G 2320/0276; G09G 2360/16; G09G 3/20; G09G 3/2003; G09G 3/2011; G09G 3/22; G09G 3/3648; G09G 3/3688; G09G 3/3696; G09G 2310/02
USPC ..... 345/76, 98–100, 212, 213, 84
See application file for complete search history.

(56) References Cited

U.S. PATENT DOCUMENTS

| | | | | |
|---|---|---|---|---|
| 6,809,711 | B2 * | 10/2004 | Funston | 345/82 |
| 7,283,115 | B2 | 10/2007 | Morii | |
| 7,710,382 | B2 * | 5/2010 | Park et al. | 345/100 |
| 7,982,705 | B2 | 7/2011 | Morii | |
| 8,310,430 | B2 * | 11/2012 | Hiratsuka | 345/100 |

FOREIGN PATENT DOCUMENTS

| | | |
|---|---|---|
| JP | 64-084298 | 3/1989 |
| JP | 09-061788 | 3/1997 |
| JP | 2002-162943 A | 6/2002 |
| JP | 2003-186416 A | 7/2003 |
| JP | 2004-085891 A | 3/2004 |
| JP | 2005-215007 A | 8/2005 |
| JP | 2009-128776 A | 6/2009 |

* cited by examiner

*Primary Examiner* — Duc Dinh
(74) *Attorney, Agent, or Firm* — Studebaker & Brackett PC

(57) ABSTRACT

A scanning line driving circuit includes an arithmetic circuit for generating an operation result for specifying a unit register for outputting an output signal by means of an arithmetic process on an output number control signal for specifying the number of signals to be outputted. An input stage of each unit register is provided with a signal control circuit for controlling whether to allow the unit register to output an output signal based on the operation result.

6 Claims, 13 Drawing Sheets

| | |
|---|---|
| FIRST OPERATION MODE | RECEIVE ONLY STVU AND STVD |
| SECOND OPERATION MODE | RECEIVE ONLY STVM |
| THIRD OPERATION MODE | IGNORE ALL INPUTS |
| FOURTH OPERATION MODE | RECEIVE ONLY OUTPUT SIGNAL AT PREVIOUS STAGE OR NEXT STAGE |

DISPLAY PANEL DRIVING CIRCUIT AND DISPLAY DEVICE

BACKGROUND OF THE INVENTION

1. Field of the Invention

The present invention relates to a driving circuit and a driving method for driving scanning lines or image signal lines of a display panel.

2. Description of the Background Art

For example, in liquid crystal display devices, a driving circuit (scanning line driving circuit) for driving scanning lines of a display panel (a liquid crystal panel) is configured so as to output signals whose number corresponds to the number of the scanning lines of the liquid crystal display panel. Similarly, a driving circuit (image signal line driving circuit) for driving image signal lines of the liquid crystal display panel is configured so as to output signals whose number corresponds to the number of the image signal lines.

In general, since the number of scanning lines and the number of image signal lines in the display panel are larger than the number of signals (the number of the output terminals) that can be outputted by one driving circuit (integrated circuit), the scanning lines and the image signal lines are driven by using a plurality of driving circuits that are cascade-connected. From a viewpoint of reduction in the cost of liquid crystal display devices, since it is preferable that the number of driving circuits to be used is smaller, the number of output terminals provided in one driving circuit tends to increase according to recent improvement of fine processing technology.

It is the most efficient that all the output terminals in a driving circuit are used. However, since resolution (the numbers of scanning lines and image signal lines) of the display panel varies, the number of required signals does not always match with the number of the output terminals in the driving circuit. Recently, since the number of the output terminals in the driving circuit increases, it is more difficult than ever to adjust the resolution of the display panel to the number of the output terminals in the driving circuit. For this reason, some output terminals of the driving circuit are not often used.

A driving circuit having a function for enabling the number of output terminals to be switched (namely, some of them can be disabled to be used) according to standard resolution of the display panel is also proposed (for example, Japanese Patent Application Laid-Open No. 2009-128776).

SUMMARY OF THE INVENTION

According to the technique disclosed in Japanese Patent Application Laid-Open No. 2009-128776, the switching of the number of the output signals is carried out by selection from some kinds where the standard resolution is assumed, and thus this technique might not be versatile enough to cope with any resolutions. Further, it is difficult for this technique to cope with display panels having special resolution.

When the resolution of the display panel does not match with the number of signals outputted from the driving circuit, a great influence is exerted on a flip vertical display function and a flip horizontal display function of a display device. A flip vertical display operation and a flip horizontal display operation are controlled by a circuit of an image signal processor. However, when the number of output signals in the driving circuit does not match with the resolution of the display panel, a lot of memories are necessary for processing image signals according to the number of the terminals in the driving circuit, and a control circuit for obtaining a display position of an image signal and outputting an image to the display position is necessary, thereby increasing a cost. When the image signal processor does not have such a control circuit, flip vertical display and flip horizontal display cannot be carried out, and thus the function of the display device is limited.

It is an object of the present invention to enable any number of output signals to be set and enable flip vertical display and flip horizontal display to be easily carried out in a driving circuit for scanning lines or image signal lines in a display device.

A driving circuit of the present invention includes a plurality of unit driving circuits and an arithmetic circuit. The plurality of unit driving circuits output signals to a plurality of scanning lines or a plurality of image signal lines of a display panel. The arithmetic circuit receives a first control signal for specifying the number of signals to be outputted from the driving circuit and executes an arithmetic process on the first control signal so as to specify a unit driving circuit which outputs the signal, out of the plurality of unit driving circuits. Each of the plurality of unit driving circuits has a signal control circuit for controlling whether to allow the unit driving circuit to output a signal based on a second control signal.

According to the present invention, since any number of the signals to be outputted from the driving circuit can be set, selection of the driving circuit based on resolution is not necessary. Further, parts of the driving circuit can be shared, and a cost of the display device can be reduced. Since the number of signals to be outputted from the driving circuit can be certainly matched with the number of the scanning lines (or image signal lines), flip vertical display and flip horizontal display processes can be realized easily (without complicating a circuit of the image signal processor). Since any unit driving circuit that is allowed to output a signal can be specified by the arithmetic process of the arithmetic circuit, a degree of wiring freedom is improved, and the driving circuit can be easily connected to a liquid crystal panel.

Any number of output terminals of the driving circuit is set from the outside, and this can cope with higher resolution. As a result, selection of an output of the driving circuit based on the resolution is not necessary, the parts of the driving circuit can be shared, and the cost can be reduced.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
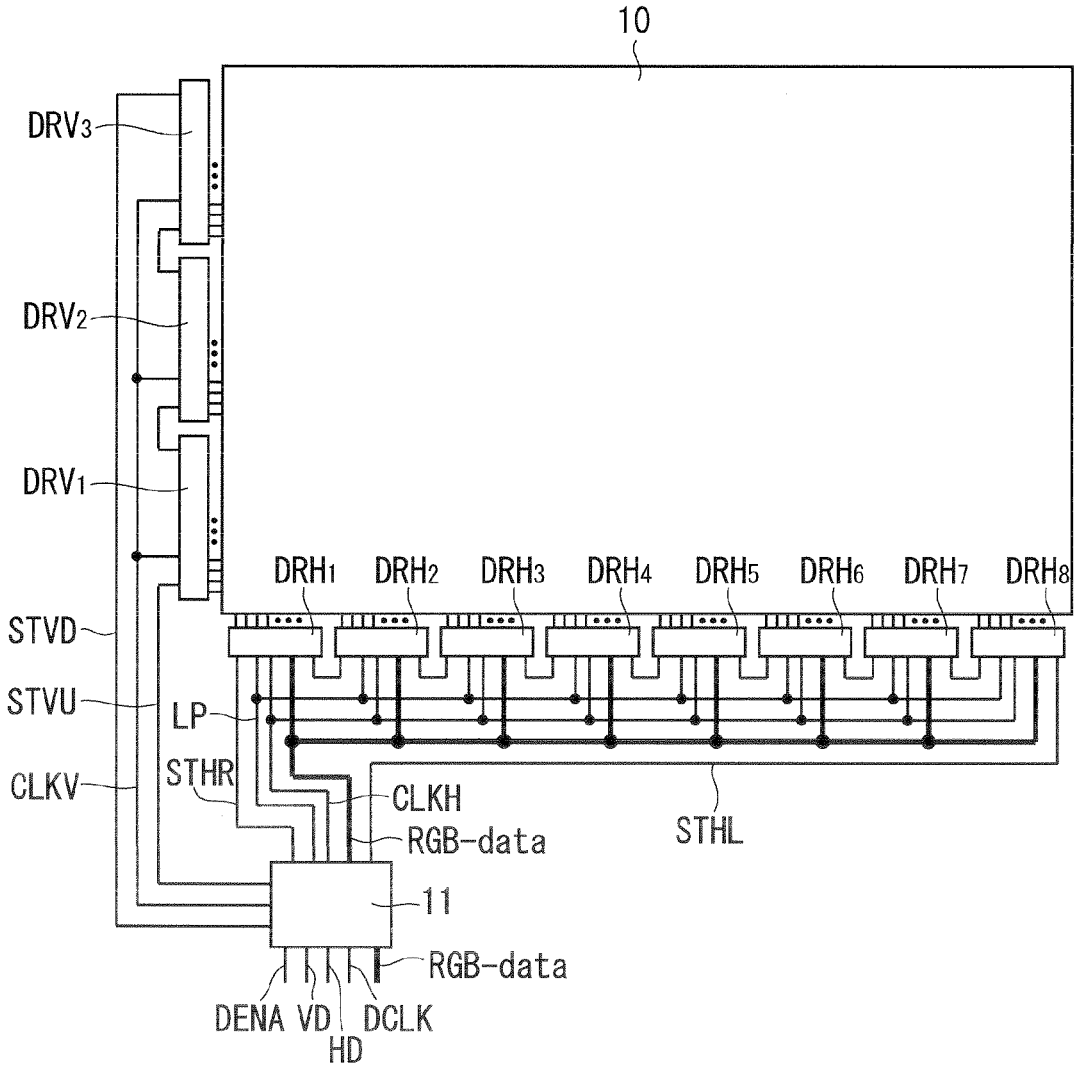
FIG. 1 is a diagram illustrating a main configuration of a liquid crystal display device according to a first preferred embodiment.

FIG. 1 is a diagram illustrating a main configuration of a liquid crystal display device according to a first preferred embodiment of the present invention. As shown in FIG. 1, the liquid crystal display device has a liquid crystal panel 10 as a display panel, a timing controller 11, image signal line driving circuits $DRH_1$ to $DRH_8$, and scanning line driving circuits $DRV_1$ to $DRV_3$.

Not shown, but the liquid crystal panel 10 is formed with a plurality of scanning lines and a plurality of image signal lines. These lines are disposed orthogonally each other, and pixels are formed near their intersections, respectively. Each of the pixels is provided with a switching element that is controlled by the scanning line and supplies an image signal to the pixel through the image signal line.

The scanning line driving circuits $DRV_1$ to $DRV_3$ are integrated circuits for driving the scanning lines. A plurality of driving circuits for driving scanning lines, respectively, are integrated on each of the scanning line driving circuits $DRV_1$ to $DRV_3$. The plurality of driving circuits are cascade-connected inside each of the scanning line driving circuits $DRV_1$ to $DRV_3$ so as to compose a shift register. As shown in FIG. 1, the three scanning line driving circuits $DRV_1$ to $DRV_3$ are also cascade-connected. As a result, all the driving circuits that are integrated on the scanning line driving circuits $DRV_1$ to $DRV_3$ are cascade-connected so as to compose the shift register. Hereinafter, the driving circuits corresponding to respective stages of the shift registers are called "unit registers".

The image signal line driving circuits $DRH_1$ to $DRH_8$ are integrated circuits for sending image data to the image signal lines. A plurality of driving circuits for sending image data to the respective image signal lines are integrated on each of the image signal line driving circuits $DRH_1$ to $DRH_8$. Each of the driving circuits retains the image data, and includes a latch circuit for outputting the image data to each of the image signal lines according to a latch pulse LP, described later. Shift registers for defining the timing at which the latch circuits capture image data are also integrated on each of the image signal line driving circuits $DRH_1$ to $DRH_8$. The unit registers are cascade-connected on each of the image signal line driving circuits $DRH_1$ to $DRH_8$. As shown in FIG. 1, the eight image signal line driving circuits $DRH_1$ to $DRH_8$ are also cascade-connected. As a result, all the unit registers in the image signal line driving circuits $DRH_1$ to $DRH_8$ are cascade-connected.

The timing controller 11 receives a data enable signal DENA, a horizontal synchronizing signal HD, a vertical synchronizing signal VD and a clock DCLK as signals (control reference signals) to be a standard of control over the image signal line driving circuits $DRH_1$ to $DRH_8$ and the scanning line driving circuits $DRV_1$ to $DRV_3$ as well as RGB-data including red, green and blue image data. The data enable signal DENA is a signal representing a period for which the RGB-data is valid. The horizontal synchronizing signal HD is a signal for synchronization in a horizontal direction of the liquid crystal panel 10. The vertical synchronizing signal VD is a signal for synchronization in a vertical direction. The clock DCLK is a reference clock for defining an operation timing of the timing controller 11.

The timing controller 11 generates control signals for controlling the operations of the image signal line driving circuits $DRH_1$ to $DRH_8$ and the scanning line driving circuits $DRV_1$ to $DRV_3$ based on these control reference signals.

The control signals for the image signal line driving circuits $DRH_1$ to $DRH_8$ include a clock CLKH (hereinafter, "horizontal clock"), a start signal STHR for forward scan (hereinafter, "forward horizontal start signal"), a start signal STHL for reverse scan (hereinafter, "reverse horizontal start signal"), and the latch pulse LP. The horizontal clock CLKH is a reference clock of the operations of the image signal line driving circuits $DRH_1$ to $DRH_8$. As to the horizontal scan, scan from left to right on a screen of the liquid crystal panel 10 is defined as "forward scan", and scan from right to left is defined as "reverse scan".

The forward horizontal start signal STHR is a pulse signal representing a head of each line in RGB-data at the time of forward scan. The forward horizontal start signal STHR is inputted into the shift register of the image signal line driving circuit $DRH_1$. Timings of capturing image data in the driving circuits at the time of forward scan are defined by this signal. Since all the unit registers in the image signal line driving circuits $DRH_1$ to $DRH_8$ are cascade-connected, when the forward horizontal start signal STHR is inputted into the image signal line driving circuit $DRH_1$, all the latch circuits in the image signal line driving circuits $DRH_1$ to $DRH_8$ can sequentially capture RGB-data serially transmitted.

The reverse horizontal start signal STHL is a pulse signal representing a head of each line in RGB-data at the time of reverse scan. The reverse horizontal start signal STHL is inputted into the shift register of the image signal line driving circuit $DRH_8$. Timings at which the driving circuits capture image data in the reverse scan are defined by this signal. When the reverse horizontal start signal STHL is inputted into the image signal line driving circuit $DRH_8$, all the latch circuits in the image signal line driving circuits $DRH_1$ to $DRH_8$ cap capture RGB-data in reverse order of the forward scan.

The latch pulse LP is a signal for defining a timing at which the RGB-data captured and retained by the latch circuits of the image signal line driving circuits $DRH_1$ to $DRH_8$ is outputted to the image signal lines of the liquid crystal panel 10.

The control signals for the image signal line driving circuits $DRH_1$ to $DRH_8$ include also a polarity inversion signal for inverting polarity of liquid crystal driving. The timing controller 11 transmits these control signals as well as the RGB-data to the image signal line driving circuits $DRH_1$ to $DRH_8$.

On the other hand, the control signals of the scanning line driving circuits $DRV_1$ to $DRV_3$ include a clock CLKV (hereinafter, "vertical clock"), a start signal STVU for the forward scan (hereinafter, "a forward vertical start signal"), and a start signal STVD for the reverse scan (hereinafter, "a reverse vertical start signal"). The vertical clock CLKV is a reference clock of operations of the scanning line driving circuits $DRV_1$ to $DRV_3$. As the vertical scan, scan from bottom to top on the screen of the liquid crystal panel 10 is defined as "forward scan", and scan from top to bottom is defined as "reverse scan".

The forward vertical start signal STVU is a pulse signal representing a head of each frame at the time of the forward scan. The forward vertical start signal STVU is inputted into the shift register of the scanning line driving circuit $DRV_1$, and a drive timing of each scanning line in the forward scan is defined by this signal. Since all the unit registers in the scanning line driving circuits $DRV_1$ to $DRV_3$ are cascade-connected, when the forward vertical start signal STVU is inputted into the scanning line driving circuit $DRV_1$, the shift register composed of the scanning line driving circuits $DRV_1$ to $DRV_3$ activates the scanning lines of the liquid crystal panel 10 sequentially from bottom to top. On pixels connected to the activated scanning lines, the switching elements are turned on, and the pixels are brought into a writable state.

The reverse vertical start signal STVD is a pulse signal representing a head of each frame at the time of reverse scan. The reverse vertical start signal STVD is inputted into the shift register of the scanning line driving circuit $DRV_3$, and the drive timing of the scanning lines in the reverse scan is defined by this signal. When the reverse vertical start signal STVD is inputted into the scanning line driving circuit $DRV_3$, the shift register composed of the scanning line driving circuits $DRV_1$ to $DRV_3$ activates the scanning lines of the liquid crystal panel 10 sequentially from top to bottom.

The scanning line driving circuits $DRV_1$ to $DRV_3$ activate the scanning lines of the liquid crystal panel 10 sequentially so as to bring the pixels of the respective lines into the writable state. The image signal line driving circuits $DRH_1$ to $DRH_8$ write the RGB-data of respective lines into the pixels through the image signal lines, respectively. When this operation is repeated, an image is displayed on the entire liquid crystal panel 10.

Figure 2:
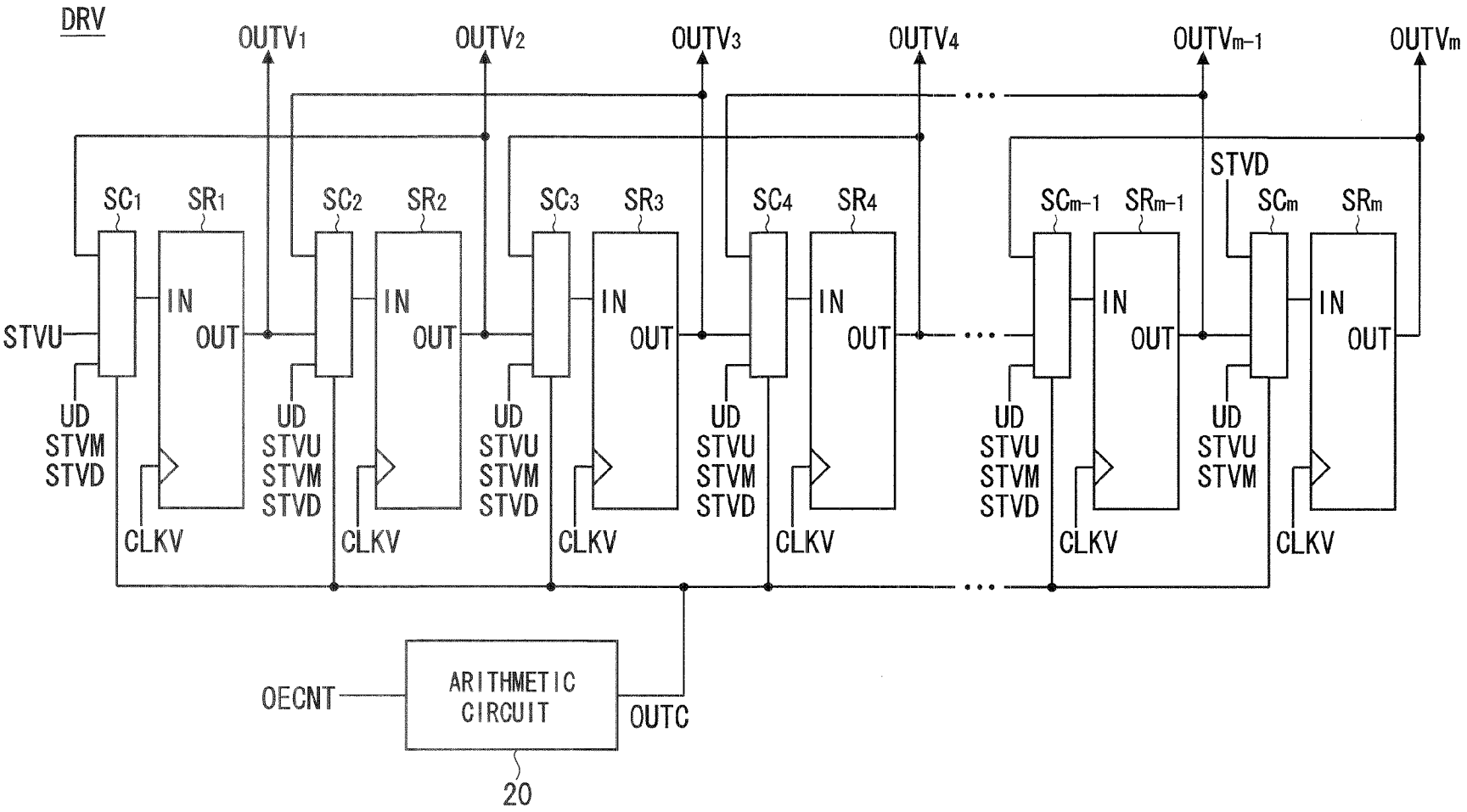
FIG. 2 is a block diagram illustrating a scanning line driving circuit according to the first preferred embodiment.

FIG. 2 is a block diagram illustrating the scanning line driving circuit according to the first preferred embodiment. FIG. 1 illustrates the configuration where the three scanning line driving circuits $DRV_1$ to $DRV_3$ are cascade-connected, but representative one of them is illustrated here.

The scanning line driving circuit DRV is the shift register that is configured so that a plurality (m stages) of unit registers $SR_i$ (i=1, 2, . . . , m) are cascade-connected. Each of the unit registers $SR_i$ has a signal control circuit $SC_i$ at its input stage. The scanning line driving circuit DRV is provided with an arithmetic circuit 20 as a control circuit of the signal control circuit $SC_i$. The signal control circuit $SC_i$ provided to each of the unit registers $SR_i$ controls whether to allow each of the unit registers $SR_i$ to output an output signal $OUTV_i$ based on an operation result OUTC outputted from the arithmetic circuit 20.

The output signals $OUTV_i$ of the unit registers $SR_i$ are used for driving the scanning lines. Not shown, but each output terminal OUT of each unit register $SR_i$ is provided with a voltage converter (level shifter) for converting the output signal $OUTV_i$ into a voltage level for enabling the scanning lines to be driven. The unit register $SR_i$ can control advisability of output of the output signal $OUTV_i$ based on an output enable signal inputted from the timing controller 11.

Each of the signal control circuits $SC_i$ receives an output signal $OUTV_i$ at a previous stage, an output signal $OUTV_{i+1}$ at a next stage, the forward vertical start signal STVU, the reverse vertical start signal STVD, a scanning direction control signal UD for controlling a scanning direction, and a restart signal STVM, described later (the restart signal STVM is used in a third preferred embodiment).

In a case of one scanning line driving circuit DRV, the output signal $OUTV_{i-1}$ at the previous stage is not inputted into the signal control circuit $SC_1$ provided to the unit register $SR_1$ at the first stage. However, when another scanning line driving circuit DRV is cascade-connected at the previous stage, a signal from the scanning line driving circuit DRV at the previous stage is inputted thereinto instead. Similarly, in the case of one scanning line driving circuit DRV, the output signal $OUTV_{i+1}$ at the next stage is not inputted into the signal control circuit $SC_m$ provided to the unit register $SR_m$ at the last stage. However, when another scanning line driving circuit DRV is cascade-connected at the next stage, a signal from the scanning line driving circuit DRV at the next stage is inputted thereinto as the output signal $OUTV_{i+1}$ at the next stage.

Each of the respective signal control circuits $SC_i$ has a decoder into which the operation result OUTC outputted from the arithmetic circuit 20 is inputted, and the operation mode is switched according to the operation result OUTC. The operation mode of the signal control circuit $SC_i$ includes four modes shown in FIG. 3.

In a first operation mode, the signal control circuit $SC_i$ receives only the forward vertical start signal STVU and the reverse vertical start signal STVD, and inputs them into the input terminal IN of the unit register $SR_i$.

In a second operation mode, the signal control circuit $SC_i$ receives only the restart signal STVM, and inputs it into the input terminal IN of the unit register $SR_i$ (the second operation mode is used in the third preferred embodiment).

In a third operation mode, the signal control circuit $SC_i$ ignores all signals and inputs nothing into the input terminal IN of the unit register $SR_i$.

In a fourth operation mode, the signal control circuit $SC_i$ receives the output signal $OUTV_{i-1}$ at the previous stage and the output signal $OUTV_{i+1}$ at the next stage, and inputs any one of them into the input terminal IN of the unit register $SR_i$.

In the fourth operation mode, the signal control circuit $SC_i$ is switched by the scanning direction control signal UD so as to input any one of the output signal $OUTV_{i-1}$ at the previous stage and the output signal $OUTV_{i+1}$ at the next stage into the input terminal IN of the unit register $SR_i$. When the output signal $OUTV_{i-1}$ at the previous stage is inputted into the input terminal IN of the unit register $SR_i$, the forward scan is carried out. When the output signal $OUTV_{i+1}$ at the next stage is inputted, the reverse scan is carried out.

That is, the scanning direction control signal UD functions as a signal for switching the scanning direction. In the first preferred embodiment, when the scanning direction control signal UD is at an L (Low) level, the output signal $OUTV_{i-1}$ at the previous stage is inputted into the input terminal IN of the unit register $SR_i$ so that the forward scan is carried out. On the contrary, when the scanning direction control signal UD is at an H (High) level, the output signal $OUTV_{1+1}$ at the next stage is inputted into the input terminal IN of the unit register $SR_i$ so that the reverse scan is carried out. Not shown in FIG. 1, but the scanning direction control signal UD is outputted from the timing controller 11.

Figures 3, 4:
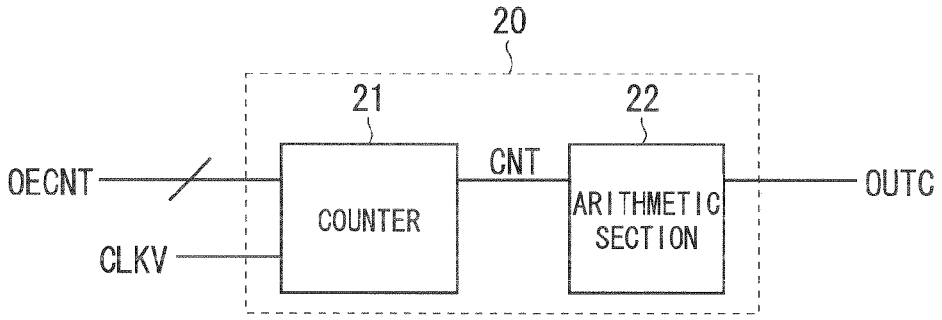
FIG. 3 is a diagram for describing respective operation modes of the signal control circuit in the scanning line driving circuit according to the first preferred embodiment.
FIG. 4 is a block diagram illustrating an arithmetic circuit in the scanning line driving circuit according to the first preferred embodiment.

FIG. 4 is block diagram illustrating a configuration of the arithmetic circuit 20. The arithmetic circuit 20 is composed of a counter 21 and an arithmetic section 22. The counter 21 receives the output number control signal OECNT (first control signal) for specifying the number of signals (the output signals $OUTV_i$) to be outputted from the scanning line driving circuit DRV. In the first preferred embodiment, the output number control signal OECNT is a pulse signal having a pulse width according to the number of the signals to be outputted from the scanning line driving circuit DRV. The counter 21 counts the pulse width of the output number control signal OECNT using the vertical clock CLKV.

For example, when the scanning line driving circuit DRV is allowed to output n signals, the pulse width of the output number control signal OECNT is set to a length of n periods of the vertical clock CLKV. In the first preferred embodiment, the pulse width (the number of signals to be outputted from the scanning line driving circuit DRV) of the output number control signal OECNT is stored in the timing controller 11 in advance.

The arithmetic section 22 executes a predetermined arithmetic process on a count number CNT as a result of counting the pulse width of the output number control signal OECNT by means of the counter 21, and outputs an operation result OUTC (a second control signal) to each of the signal control circuits $SC_i$. Each of the signal control circuits $SC_i$ specifies one of the unit registers $SR_1$ to $SR_m$ that outputs the signal based on the value of the operation result OUTC, and accordingly the operation mode is switched.

Figure 5:
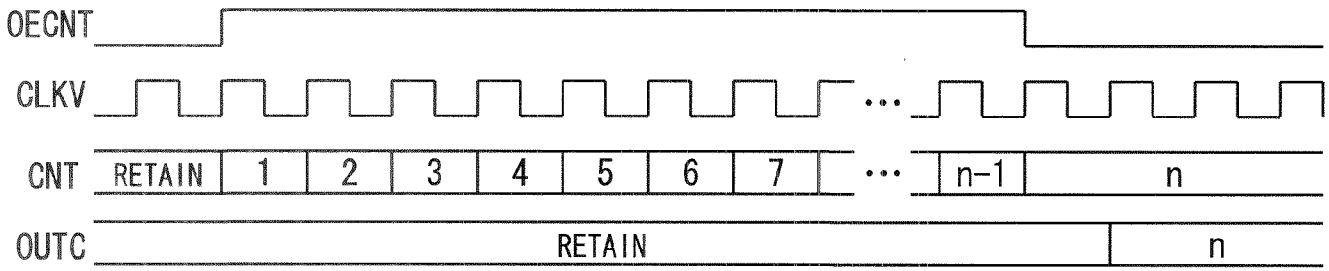
FIG. 5 is a diagram illustrating an operation of the arithmetic circuit in the scanning line driving circuit according to the first preferred embodiment.

In the first preferred embodiment, the arithmetic section 22 outputs the operation result OUTC whose value is the same as that of the count number CNT. FIG. 5 is a diagram illustrating an operation of the arithmetic circuit 20 in this case. The counter 21 counts a rise of the vertical clock CLKV (transition from the L level to the H level) for a period for which the output number control signal OECNT is at the H level, so as to count the pulse width of the output number control signal OECNT. When the arithmetic section 22 obtains the count number CNT of the output number control signal OECNT that falls (transition from the H level to the L level), and outputs it as the operation result OUTC.

The arithmetic section 22 retains a value of the previous operation result OUTC until the fall of the output number control signal OECNT is detected. When the count number CNT is 0, namely, the output number control signal OECNT is not inputted, a maximum value (the number of the output terminals) of the number of signals capable of being outputted from the scanning line driving circuit DRV is outputted as an initial set value of the operation result OUTC. In the example of FIG. 2, the initial set value of the operation result OUTC is m.

A relationship between the operation result OUTC outputted from the arithmetic circuit 20 and the operation mode of the signal control circuit $SC_i$ in the first preferred embodiment will be described.

At the time of forward scan, when the value of the operation result OUTC is n, the signal control circuit $SC_1$ at the first stage enters the first operation mode, the signal control circuits $SC_2$ to $SC_n$ at the second to n-th stages enter the fourth operation mode, and the signal control circuits $SC_{n+1}$ to $SC_m$ at stages after the signal control circuit $SC_n$ enter the third operation mode.

At the time of reverse scan, when the value of the operation result OUTC is n, the signal control circuit $SC_n$ at the n-th stage enters the first operation mode, the signal control circuits $SC_1$ to $SC_{n-1}$ at the first to (n−1)th stages enter the fourth operation mode, and the signal control circuits $SC_{n+1}$ to $SC_m$ at stages after the signal control circuit $SC_n$ enter the third operation mode.

Figure 6:
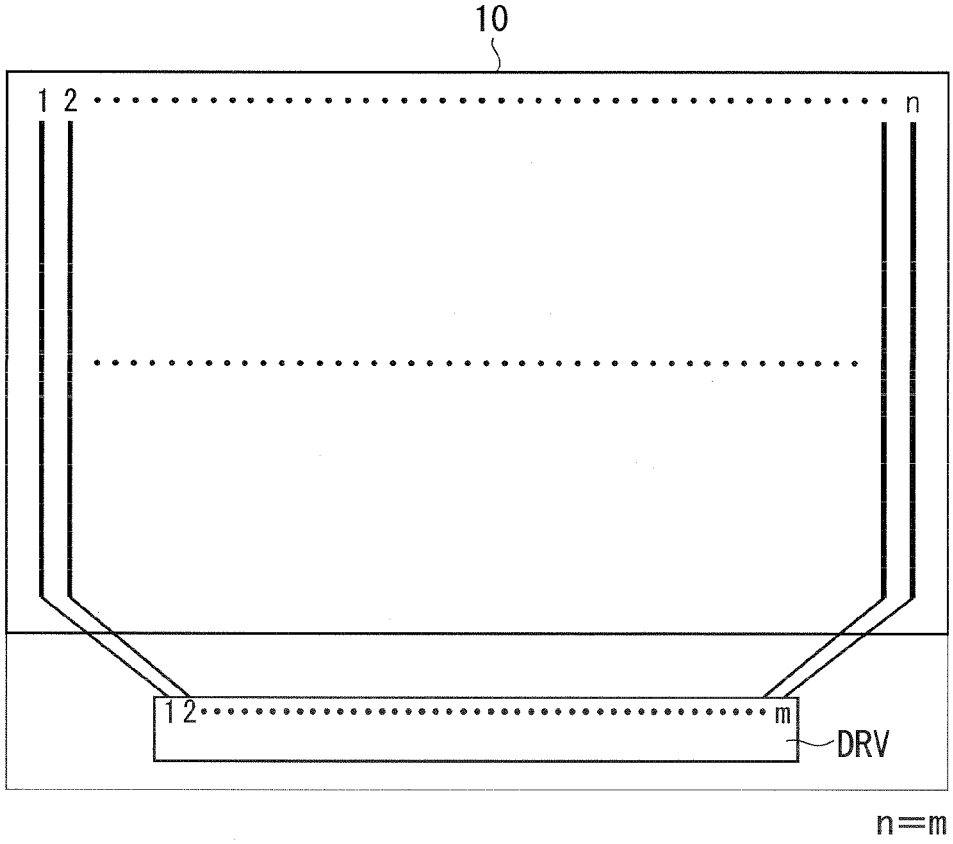
FIG. 6 is a diagram illustrating one example of a connecting state between the scanning line driving circuit and the liquid crystal panel according to the first preferred embodiment.

FIG. 6 is a diagram illustrating one example of a connecting state of the scanning line driving circuit DRV and the liquid crystal panel 10 according to the first preferred embodiment. FIG. 1 illustrates an example where the three scanning line driving circuits $DRV_1$ to $DRV_3$ are cascade-connected to be used. However, for simple description, here FIG. 6 illustrates an example where one scanning line driving circuit DRV drives the n scanning lines of the liquid crystal panel 10. In recent years where micro-machining technology is improved, the number of signals that can be outputted by one scanning line driving circuit increases. Actually, in some cases, the liquid crystal panel is driven by only one scanning line driving circuit.

FIG. 6 illustrates a case where the number n of the scanning lines of the liquid crystal panel 10 is equal to the number m of the output terminals of the scanning line driving circuit DRV (n=m). All the output terminals of the scanning line driving circuit DRV can be connected to the scanning lines of the liquid crystal panel 10, and thus this case is the most efficient.

In this case, the scanning line driving circuit DRV should output m signals using all the output terminals. Therefore, the pulse width of the output number control signal OECNT is set to a length of an m period of the vertical clock CLKV, and the value of the operation result OUTC outputted by the arithmetic circuit 20 is m. Alternatively, the output number control signal OECNT is not inputted into the arithmetic circuit 20, and the initial set value m may be outputted as the operation result OUTC. That is, in a case of FIG. 6, the timing controller 11 that does not have the function for outputting the output number control signal OECNT can be used.

Figure 7:
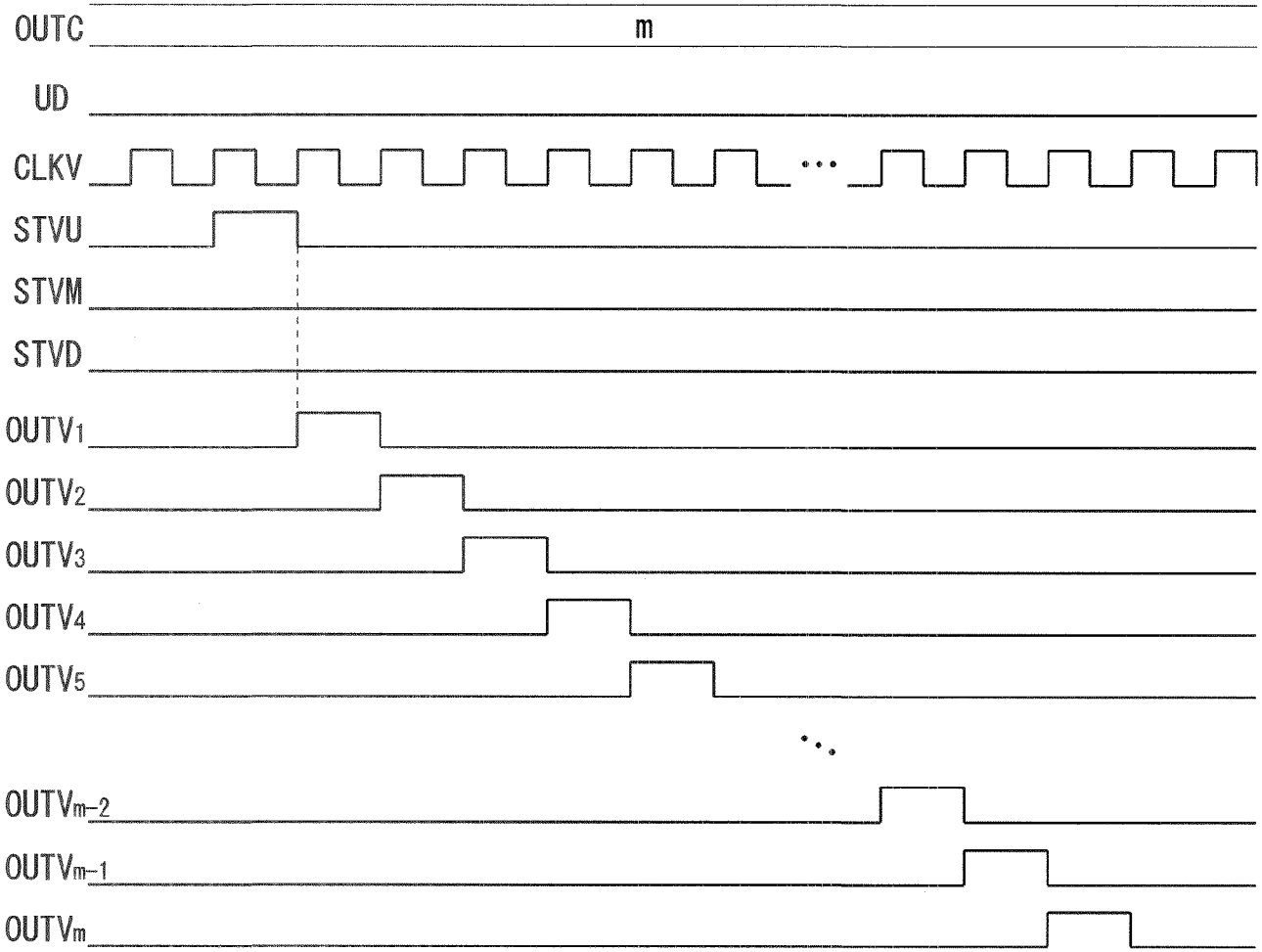
FIG. 7 is a timing chart for describing an operation of the scanning line driving circuit at the time of forward scan according to the first preferred embodiment.

FIG. 7 is a timing chart illustrating the operation of the scanning line driving circuit DRV in the configuration of FIG. 6, and illustrates a case where the forward scan is carried out (the scanning direction control signal UD is at the L level). Since the value of the operation result OUTC is m, the signal control circuit $SC_1$ enters the first operation mode, and the other signal control circuits $SC_2$ to $SC_m$ enter the fourth operation mode.

In this case, when the forward vertical start signal STVU is at the H level, the output signals $OUTV_1$, $OUTV_2$ . . . , $OUTV_m$ synchronize with the vertical clock CLKV so as to be at the H level successively in this order. As a result, the n scanning lines of the liquid crystal panel 10 are sequentially activated.

Figure 8:
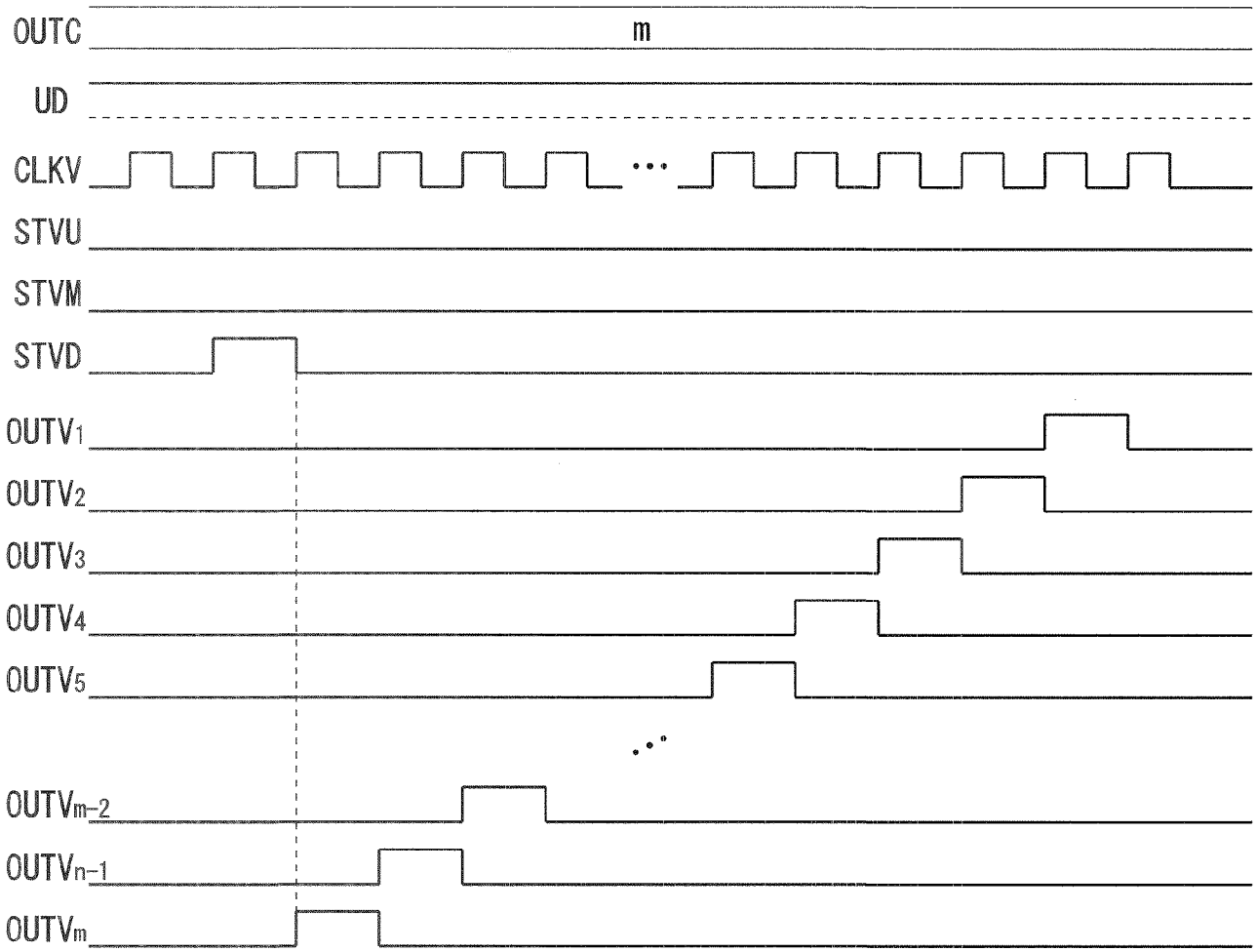
FIG. 8 is a timing chart for describing an operation of the scanning line driving circuit at the time of reverse scan according to the first preferred embodiment.

FIG. 8 is a timing chart illustrating the operation of the scanning line driving circuit DRV in the configuration of FIG. 6, and illustrates a case where the reverse scan is carried out (the scanning direction control signal UD is at the H level). Since the value of the operation result OUTC is m, the signal control circuit $SC_m$ enters the first operation mode, and the other signal control circuits $SC_1$ to $SC_{m-1}$ enter the fourth operation mode.

In this case, when the reverse vertical start signal STVD is at the H level, the output signals $OUTV_m$, $OUTV_{m-1}$, . . . , $OUTV_1$ synchronize with the vertical clock CLKV so as to be at the H level successively in this order. As a result, n scanning lines of the liquid crystal panel 10 are activated in reverse order to the forward scan.

Figure 9:
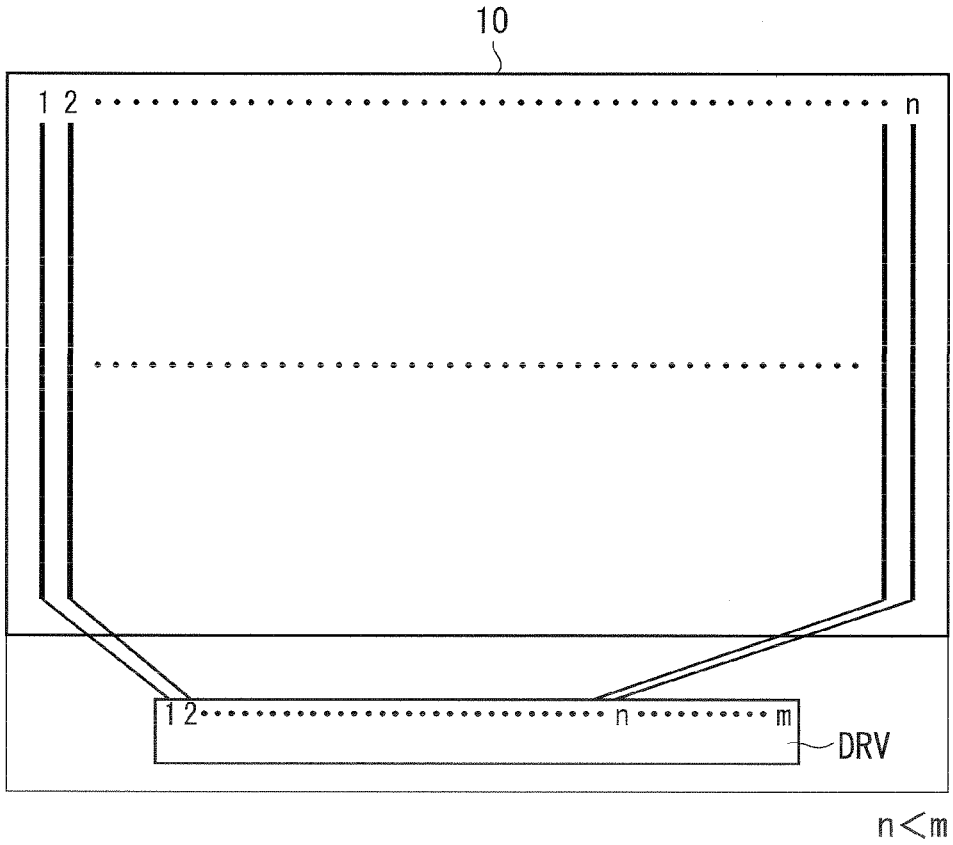
FIG. 9 is a diagram illustrating one example of a connecting state between the scanning line driving circuit and the liquid crystal panel according to the first preferred embodiment.

FIG. 9 is a diagram illustrating another example of the connected state between the scanning line driving circuit DRV and the liquid crystal panel 10 according to the first preferred embodiment, and illustrates a case where the number n of scanning lines of the liquid crystal panel 10 is smaller than the number m of the output terminals of the scanning line driving circuit DRV (n<m). As shown in FIG. 9, the n scanning lines are connected to the first to n-th output terminals of the scanning line driving circuit DRV.

In this case, the number of the signals to be outputted from the scanning line driving circuit DRV should be reduced to n. Concretely, the output signals $OUTV_1$ to $OUTV_n$ are outputted, and the outputs of the output signals $OUTV_{n+1}$ to $OUTV_m$ are stopped. Therefore, the pulse width of the output number control signal OECNT is set to the length of an n period of the vertical clock CLKV, and the value of the operation result OUTC outputted from the arithmetic circuit 20 is n.

Figure 10:
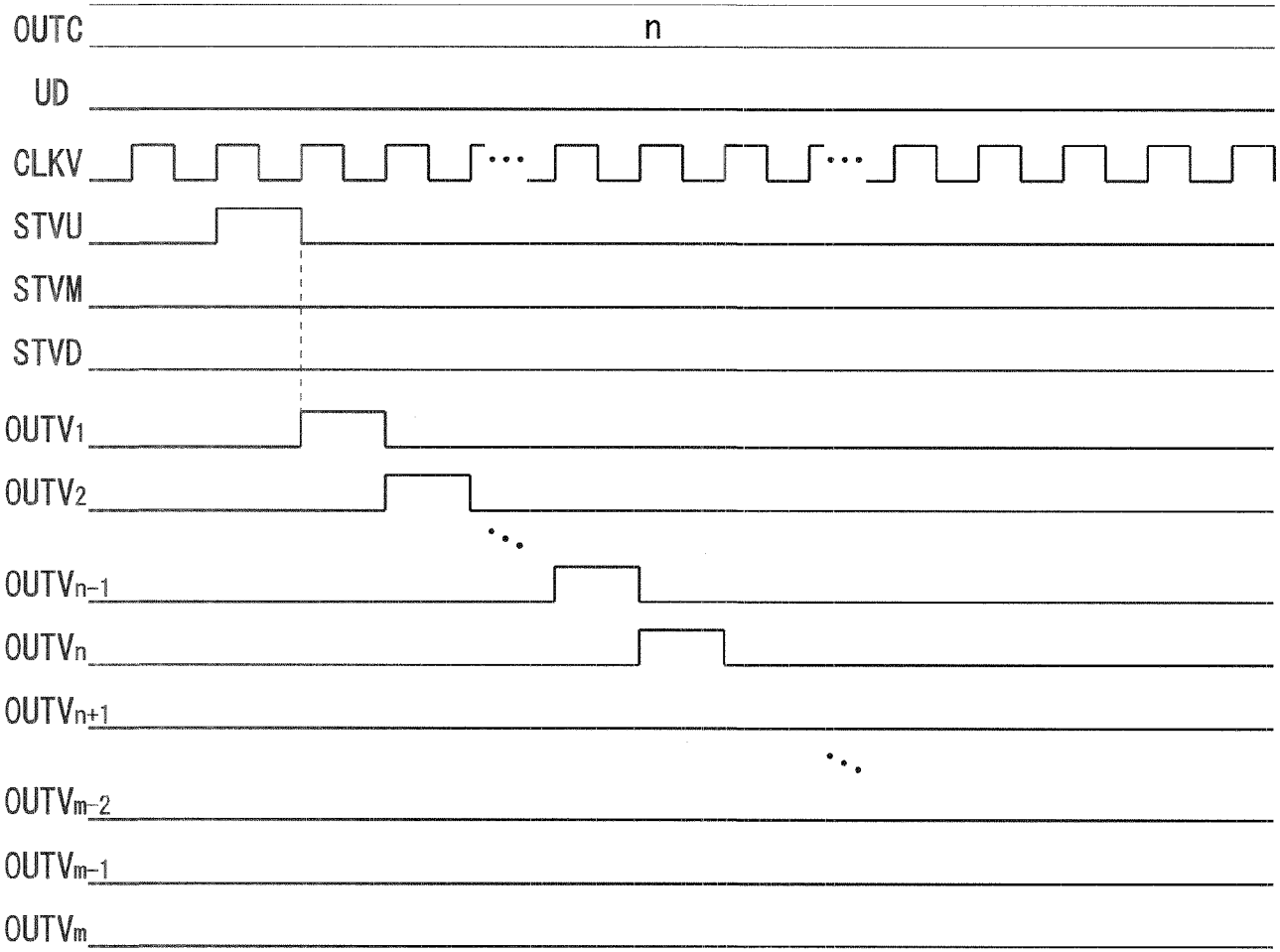
FIG. 10 is a timing chart for describing an operation of the scanning line driving circuit at the time of the forward scan according to the first preferred embodiment.

FIG. 10 is a timing chart illustrating an operation of the scanning line driving circuit DRV in the configuration of FIG. 9, and illustrates a case where the forward scan is carried out. Since the value of the operation result OUTC is n, the signal control circuit $SC_1$ enters the first operation mode, and the signal control circuits $SC_2$ to $SC_n$ enter the fourth operation mode. The signal control circuits $SC_{n+1}$ to $SC_m$ at stages after the signal control circuit $SC_n$ enter the third operation mode.

In this case, when the forward vertical start signal STVU is at the H level, the output signals $OUTV_1$, $OUTV_2$, . . . , $OUTV_n$ synchronize with the vertical clock CLKV so as to be at the H level successively in this order. As a result, the n scanning lines of the liquid crystal panel 10 are sequentially activated. The output signals $OUTV_{n+1}$ to $OUTV_m$ are maintained at the L level.

A timing chart is omitted, but in the configuration of FIG. 9, at the time of reverse scan, the signal control circuit $SC_n$ enters the first operation mode, and the signal control circuits $SC_1$ to $SC_{n-1}$ enter the fourth operation mode. Further, the signal control circuits $SC_{n+1}$ to $SC_m$ enter the third operation mode. Therefore, when the reverse vertical start signal STVD is at the H level, the output signals $OUTV_n$, $OUTV_{n-1}$, . . . , $OUTV_1$ synchronize with the vertical clock CLKV so as to be at the H level successively in this order.

According to the first preferred embodiment, since any number of signals outputted from the scanning line driving circuit DRV can be set by using the output number control signal OECNT, this preferred embodiment can cope with various resolutions including special resolution. The driving circuits to be used does not have to be changed according to the resolution, and a reduction in the cost due to commoditizing of the parts can be expected. Since the scanning direction can be easily switched, flip vertical display is enabled without complicating a circuit of the image processing section.

The number of signals to be outputted from the scanning line driving circuit DRV is specified by using the pulse width of the output number control signal OECNT, so that the number of the signal lines can be one. Therefore, a wiring area for the output number control signal OECNT can be repressed to a minimum. Since the degree of wiring freedom is heightened, the driving circuits and the liquid crystal panel can be easily connected, thereby contributing to improvement in the design of display devices.

Second Preferred Embodiment

In the first preferred embodiment, when the number m of the output terminals of the scanning line driving circuit DRV is smaller than the number n of scanning lines of the liquid crystal panel 10, the scanning lines are driven by using the n output terminals (namely, the first to n-th output terminals) counted from the first output terminal of the scanning line driving circuit DRV (FIG. 9 and FIG. 10). However, any terminals of the scanning line driving circuit DRV may be used. The output terminals to be used can be determined by arithmetic in the arithmetic section 22 and mode setting of the signal control circuit $SC_i$.

Figure 11:
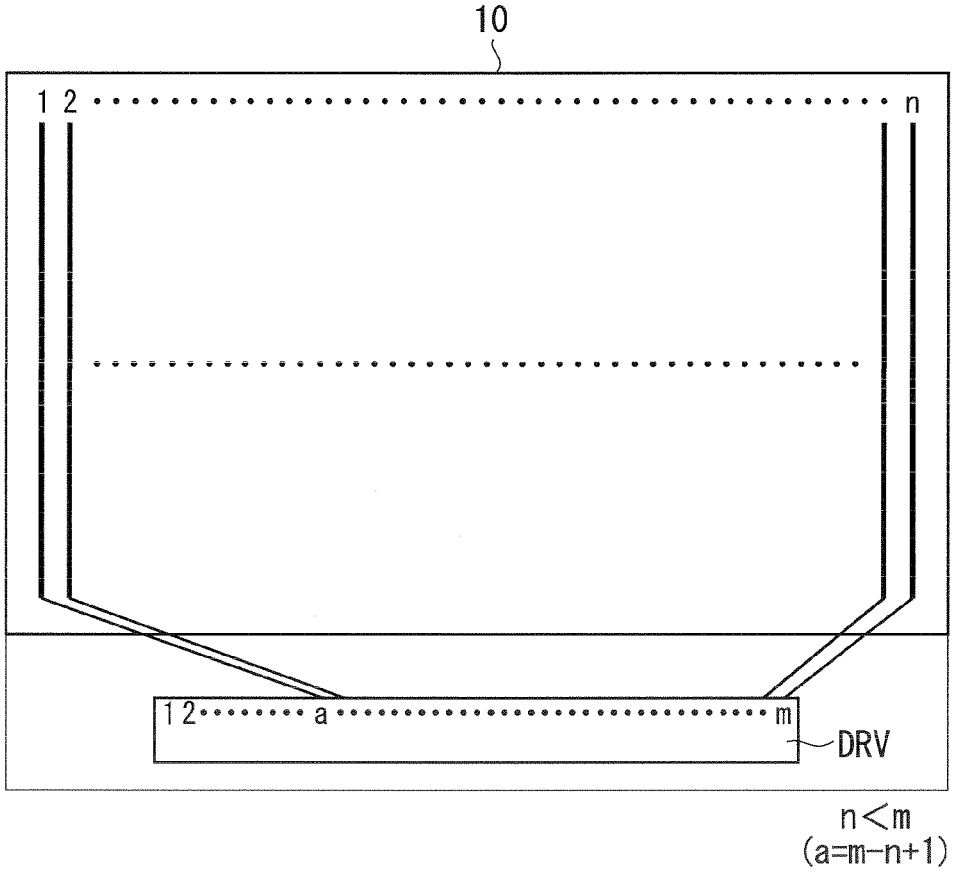
FIG. 11 is a diagram illustrating one example of a connecting state between the scanning line driving circuit and the liquid crystal panel according to a second preferred embodiment.

The second preferred embodiment, as shown in FIG. 11, illustrates an example where the n output terminals counted reversely from the m-th output terminal are used. In FIG. 11, the a-th to m-th output terminals are used, but when a=m−n+1, the n output terminals are used.

In the second preferred embodiment, the arithmetic section 22 of the arithmetic circuit 20 performs a=m−n+1, and outputs the value a as the operation result OUTC. The operation modes of the signal control circuits $SC_i$ are determined based on the value a.

When the scanning line driving circuit DRV carries out the forward scan, the signal control circuit $SC_a$ at the a-th stage enters the first operation mode, the signal control circuits $SC_{a+1}$ to $SC_m$ at the (a+1)th to m-th stages enter the fourth operation mode, and the signal control circuits $SC_1$ to $SC_{a-1}$ at stages before the signal control circuit $SC_a$ enter the third operation mode.

Figure 12:
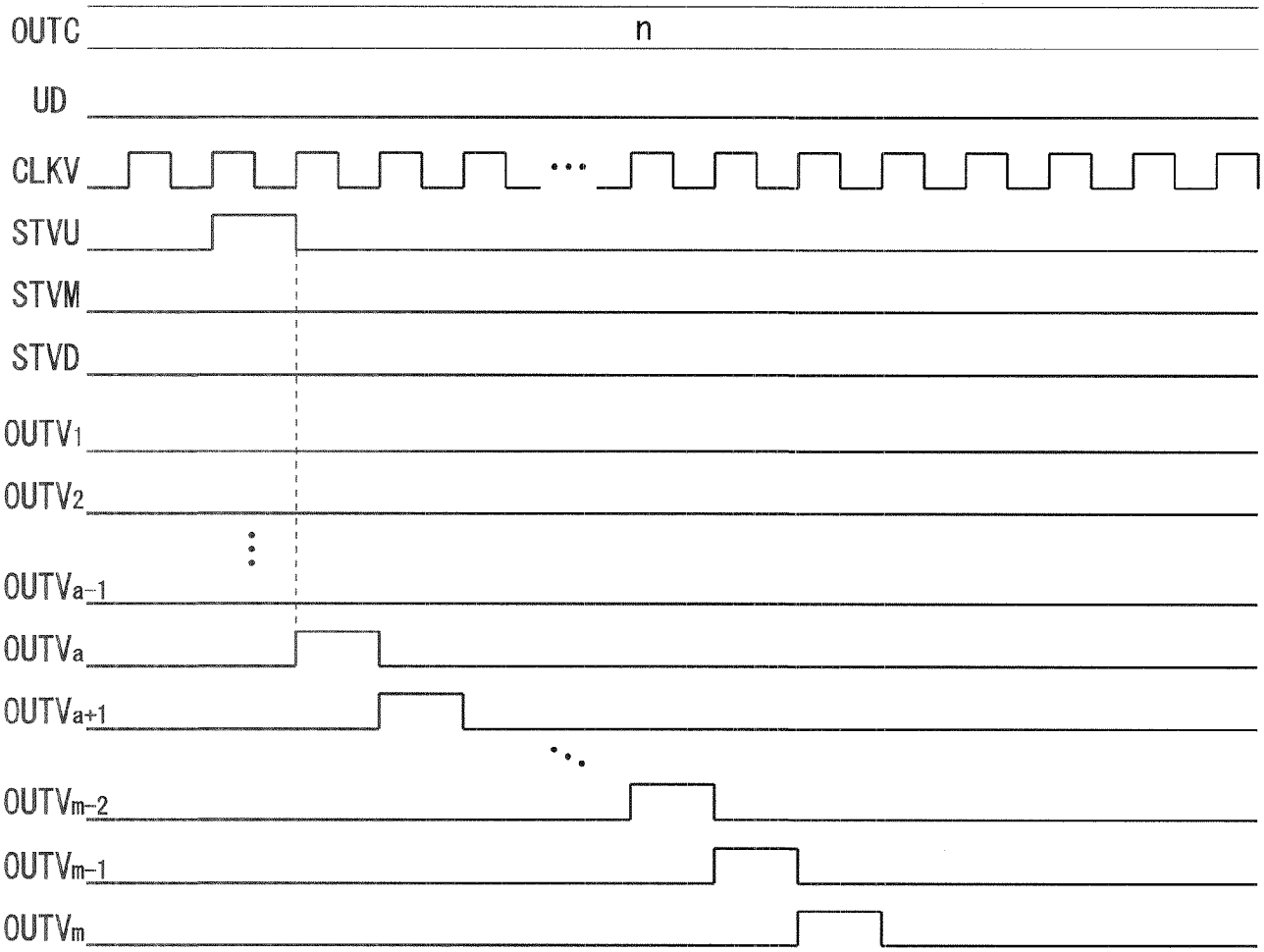
FIG. 12 is a timing chart for describing an operation of the scanning line driving circuit at the time of the forward scan according to a third preferred embodiment.

FIG. 12 is a timing chart illustrating the operation of the scanning line driving circuit DRV in this case. In this case, when the forward vertical start signal STVU is at the H level, the output signals $OUTV_a$, $OUTV_{a+1}$, . . . , $OUTV_m$ synchronize with the vertical clock CLKV so as to be at the H level successively in this order. As a result, the n scanning lines of the liquid crystal panel 10 are sequentially activated. The output signals $OUTV_1$ to $OUTV_{a-1}$ are maintained at the L level.

When the scanning line driving circuit DRV carries out the reverse scan, the signal control circuit $SC_m$ at the m-th stage enters the first operation mode, the signal control circuits $SC_a$ to $SC_{m-1}$ at the a-th to (m−1)th stages enter the fourth operation mode, and the signal control circuits $SC_1$ to $SC_{a-1}$ at stages before the signal control circuit $SC_a$ enter the third operation mode.

A timing chart is omitted, but in this case, when the reverse vertical start signal STVD is at the H level, the output signals $OUTV_m$, $OUT_{m-1}$, . . . , $OUTV_a$ synchronize with the vertical clock CLKV so as to be at the H level successively in this order.

Also in the second preferred embodiment, the effect similar to the first preferred embodiment can be obtained. In the present invention, like the second and a third preferred embodiment, positions of the output terminals to be used can be freely changed by the arithmetic in the arithmetic section 22 and the setting of the operation mode in the signal control circuit $SC_i$. Therefore, the degree of wiring freedom is improved, and the scanning line driving circuit DRV and the liquid crystal panel 10 can be easily connected.

Third Preferred Embodiment

Figure 13:
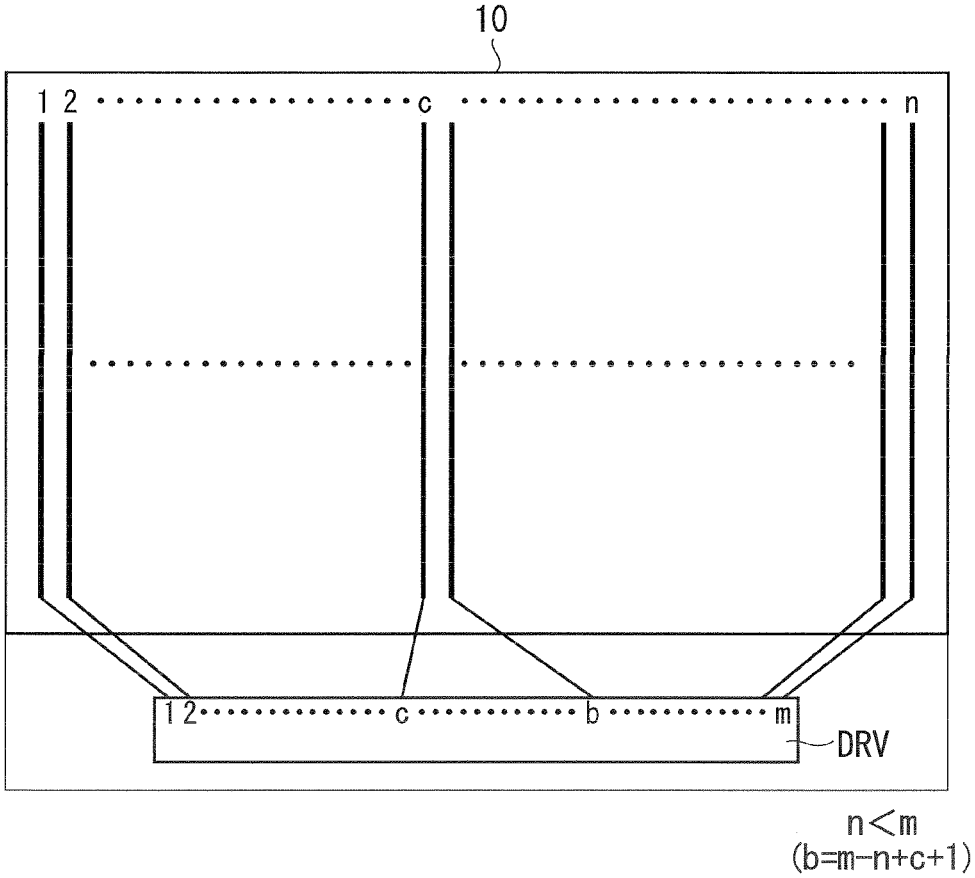
FIG. 13 is a diagram illustrating one example of a connecting state between the scanning line driving circuit and the liquid crystal panel according to a fourth preferred embodiment.

A third preferred embodiment describes, as shown in FIG. 13, an example where the output terminal at the center of the scanning line driving circuit DRV is not used and the n output terminals at both ends are used. In FIG. 13, the first to c-th output terminals and the b-th to m-th output terminals are used. When c is set to a fixed value and b=m−n+c+1, the n output terminals are used.

In the third preferred embodiment, the arithmetic section 22 of the arithmetic circuit 20 performs b=m−n+c+1, and outputs a value b as the operation result OUTC.

When the scanning line driving circuit DRV carries out the forward scan, the signal control circuit $SC_1$ at the first stage enters the first operation mode, and the signal control circuits $SC_2$ to $SC_c$ at the second to c-th stages enter the fourth operation mode. Further, the signal control circuits $SC_{+1}$ to $SC_{b-1}$ at the (c+1)th to (b−1)th stages enter the third operation mode. The signal control circuit $SC_b$ at the b-th stage enters the second operation mode, and the signal control circuits $SC_{b+1}$ to $SC_m$ at the (b+1)th to m-th stages enter the fourth operation mode.

Figure 14:
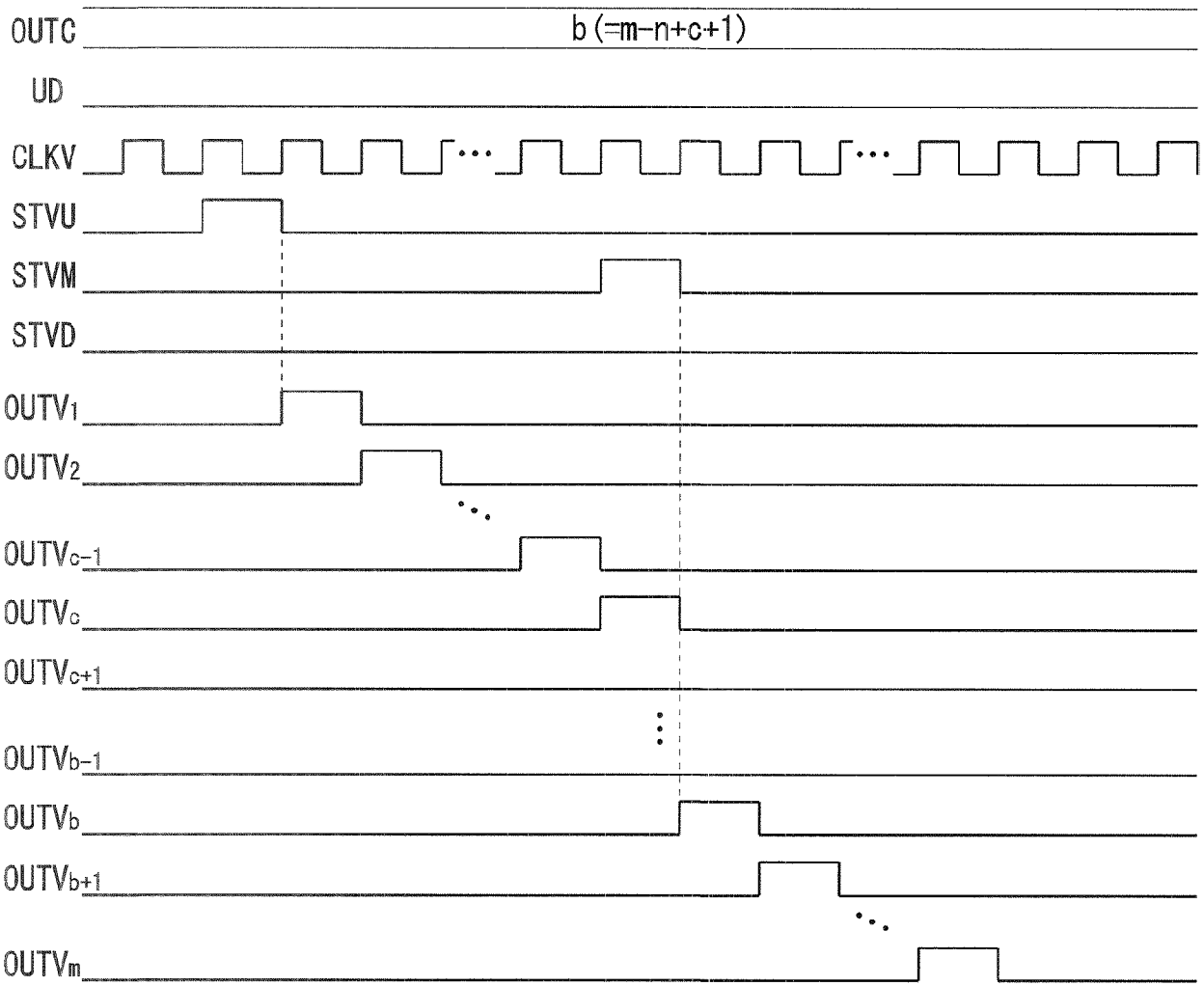
FIG. 14 is a timing chart for describing an operation of the scanning line driving circuit at the time of the forward scan according to the fourth preferred embodiment.

FIG. 14 is a timing chart illustrating an operation of the scanning line driving circuit DRV in this case. In this case, when the forward vertical start signal STVU is at the H level, output signals $OUTV_1$, $OUTV_2$, . . . , $OUTV_c$ synchronize with the vertical clock CLKV so as to be at the H level successively in this order. Thereafter, the timing controller 11 brings the restart signal STVM into the H level at the same timing as that the output signal $OUTV_c$ is at the H level. Since the restart signal STVM is inputted into the input terminal IN of the unit register $SR_b$ to which the signal control circuit $SC_b$ of the second operation mode is connected, the output signals $OUTV_b$, $OUTV_{b-1}$, . . . , $OUTV_m$ are activated after the output signal $OUTV_c$ successively. As a result, the n scanning lines of the liquid crystal panel 10 are sequentially activated. The output signals $OUTV_{c+1}$ to $OUTV_{b-1}$ are maintained at the L level.

When the scanning line driving circuit DRV carried out the reverse scan, the signal control circuit $SC_m$ at the m-th stage enters the first operation mode, and the signal control circuits $SC_b$ to $SC_{m-1}$ at the b-th to (m−1)th stages enter the fourth operation mode. Further, the signal control circuits $SC_{c+1}$ to $SC_{b-1}$ at the (c+1)th to (b−1)th stages enter the third operation mode. The signal control circuit $SC_c$ at the c-th stage enters the second operation mode, and the signal control circuits $SC_1$ to $SC_{c-1}$ at the first to (c−1)th stages enter the fourth operation mode.

A timing chart is omitted, but in this case, when the reverse vertical start signal STVD is at the H level, the output signals $OUTV_m$, $OUTV_{m-1}$, . . . , $OUTV_b$ synchronize with the vertical clock CLKV so as to be at the H level successively in this order. The timing controller 11 brings the restart signal STVM into the H level at the same timing as the output signal $OUTV_b$. Since the restart signal STVM is inputted into the input terminal IN of the unit register $SR_c$ to which the signal control circuit $SC_c$ in the second operation mode is connected, the output signals $OUTV_c$, $OUTV_{c-1}$, . . . , $OUTV_1$ are activated successively after the output signal $OUTV_b$. As a result, the n scanning lines of the liquid crystal panel 10 are activated successively in reverse order to the forward scan. The output signals $OUTV_{c+1}$ to $OUTV_{b-1}$ are maintained at the L level.

Also in the third preferred embodiment, the effect similar to the first preferred embodiment can be obtained. Since the output terminals at both the ends of the scanning line driving circuit DRV are necessarily used, as shown in FIG. 1, a plurality of scanning line driving circuits DRV are cascade-connected so as to be easily used.

Fourth Preferred Embodiment

In the first preferred embodiment, the pulse width (the number of signals to be outputted from the scanning line driving circuit DRV) of the output number control signal OECNT is stored by the timing controller 11 in advance, but the output number control signal OECNT occasionally can be generated based on another control signal.

For example, after outputting a start signal (STVU or STVD), some kinds of the timing controller 11 outputs an end signal for temporarily stopping the operation of the scanning line driving circuit DRV at timing of each frame end (the same timing as a timing when the scanning line on the final line is activated). A period from rise of the start signal to rise of the end signal corresponds to a length of the n period of the vertical clock CLKV (n is the number of scanning lines), and is equivalent to the pulse width of the output number control signal OECNT used in the first preferred embodiment. Therefore, the output number control signal OECNT can be generated as a pulse signal that is at the H level according to the rise of the start signal, and is at the L level according to the rise of the end signal.

In this configuration, the timing controller 11 can generate the output number control signal OECNT that matches with the resolution of the liquid crystal panel 10 without storing the information about the pulse width of the output number control signal OECNT in the timing controller 11 in advance.

Modified Example

The first to fourth preferred embodiments describe the example where the present invention is applied to the shift register of the scanning line driving circuit DRV, but as described before, the image signal line driving circuit DRH also has the shift register for outputting signals whose number corresponds to the number of image signal lines. The present invention can be applied also to the shift register of the image signal line driving circuit DRH.

In the above description, the pulse width of the output number control signal OECNT is set to the length corresponding to the number of signals to be outputted from the scanning line driving circuit DRV, namely, the number (n) of the output terminals to be used, but may be a length corresponding to the number (m−n) of the output terminals that are not used. Also in this case, the arithmetic section 22 can obtain the number of the output terminals to be used by means of arithmetic.

From a viewpoint of the efficiency, since the number of the output terminals to be unused is normally reduced, when the pulse width of the output number control signal OECNT is made to correspond to the number of the output terminals to be unused, the pulse width can be shortened. As a result, a time required for the arithmetic circuit 20 to determine the number of the output terminals to be used in the scanning line driving circuit DRV is shortened.

In the above description, the counter 21 counts the rise of the vertical clock CLKV, but may count the fall. The pulse width of the output number control signal OECNT is its H level period, but its L level period may be defined as the pulse width.

In the first to fourth preferred embodiments, the present invention is described by exemplifying the liquid crystal display device. However, similarly, the present invention can be applied, for example, also to the driving circuits for driving the image signal lines of the display device where organic EL or LED elements are used for display devices.

In the present invention, the respective preferred embodiments can be combined freely, and the preferred embodiments can be suitably modified or omitted within the scope of the present invention.

While the invention has been shown and described in detail, the foregoing description is in all aspects illustrative and not restrictive. It is therefore understood that numerous modifications and variations can be devised without departing from the scope of the invention.

What is claimed is:

1. A display panel driving circuit, comprising:

a plurality of unit driving circuits for outputting signals to a plurality of scanning lines or a plurality of image signal lines of a display panel; and an arithmetic circuit for receiving a first control signal for specifying the number of signals to be outputted, and generating a second control signal for specifying a unit driving circuit which outputs a signal, out of said plurality of unit driving circuits according to an arithmetic process on the first control signal, wherein each of said plurality of unit driving circuits includes a signal control circuit for controlling whether to allow the unit driving circuit to output a signal based on said second control signal, said first control signal is a pulse signal having a pulse width that varies relative to the number of said signals to be outputted, and said arithmetic circuit includes:

a counter for counting said pulse width, and an arithmetic section for generating said second control signal according to an arithmetic process on a counted value of said counter.

2. The display panel driving circuit according to claim 1, wherein said plurality of unit driving circuits are cascade-connected, and from the unit driving circuit at the first stage, unit driving circuits whose number is the same as that of said signals specified by said first control signal are allowed to output.

3. The display panel driving circuit according to claim 1, wherein said plurality of unit driving circuits are cascade-connected, and from the unit driving circuit at the last stage, unit driving circuits whose number is the same as that of said signals specified by said first control signal are allowed to output signals.

4. The display panel driving circuit according to claim 1, wherein said plurality of unit driving circuits are cascade-connected, and a predetermined number of unit driving circuits counted from the first stage and a predetermined number of unit driving circuits counted from the last stage are allowed to output signals so that totally the same number of unit driving circuits as the number of said signals specified by said first control signal are allowed to output signals.

5. A display device, comprising:

a display panel driving circuit according to claim 1; and a timing controller for defining an operation timing of said driving circuit, wherein said first control signal is supplied from said timing controller.

6. The display device according to claim 5, wherein said timing controller generates said first control signal based on a start signal for starting the operations of said plurality of unit driving circuits and an end signal for stopping the operations.

* * * * *